US009828767B2

(12) United States Patent
Lanzilotta et al.

(10) Patent No.: US 9,828,767 B2
(45) Date of Patent: Nov. 28, 2017

(54) PREFABRICATED LIGHTWEIGHT STEEL WALL TENSIONING SYSTEM

(71) Applicant: American Panel Tec Corp., South Plainfield, NJ (US)

(72) Inventors: John Lanzilotta, Whitehouse Station, NJ (US); Dawn Hopper, Montvale, NJ (US)

(73) Assignee: American Panel Tec Corp., South Plainfield, NJ (US)

( * ) Notice: Subject to any disclaimer, the term of this patent is extended or adjusted under 35 U.S.C. 154(b) by 165 days.

(21) Appl. No.: 14/922,542

(22) Filed: Oct. 26, 2015

(65) Prior Publication Data

US 2016/0115687 A1 Apr. 28, 2016

Related U.S. Application Data

(60) Provisional application No. 62/068,820, filed on Oct. 27, 2014.

(51) Int. Cl.

| | |
|---|---|
| ***E04B 2/60*** | (2006.01) |
| *E04B 1/24* | (2006.01) |
| *E04B 2/74* | (2006.01) |
| *E04C 3/04* | (2006.01) |

(52) U.S. Cl.

CPC ..... *E04B 2/60* (2013.01); *E04B 2/7414* (2013.01); *E04B 2001/2415* (2013.01); *E04B 2001/2454* (2013.01); *E04B 2001/2472* (2013.01); *E04B 2001/2496* (2013.01); *E04C 2003/0473* (2013.01)

(58) Field of Classification Search

CPC ..... E04B 2/60; E04B 2/24; E04B 2/16; E04B 2/58; E04B 1/2403; E04B 2002/0202; E04B 2001/2415

USPC ..... 52/474, 481.1, 479

See application file for complete search history.

(56) References Cited

U.S. PATENT DOCUMENTS

| | | | | |
|---|---|---|---|---|
| 5,505,031 | A * | 4/1996 | Heydon | B26D 3/006 52/241 |
| 5,862,639 | A * | 1/1999 | Abou-Rached | B28B 11/04 264/274 |
| 5,937,607 | A * | 8/1999 | Li | E04C 2/384 52/348 |
| 5,946,866 | A * | 9/1999 | Weglewski | E04H 9/022 52/167.1 |
| 7,251,920 | B2 * | 8/2007 | Timmerman, Sr. | E04B 1/0007 137/68.27 |
| 2002/0020122 | A1 * | 2/2002 | Mueller | E04B 1/26 52/167.3 |
| 2003/0205008 | A1 * | 11/2003 | Sridhara | E04H 9/02 52/167.3 |
| 2005/0235594 | A1 * | 10/2005 | Hildreth | E04B 1/24 52/633 |
| 2008/0289267 | A1 * | 11/2008 | Sarkisian | E04H 9/02 52/167.3 |
| 2010/0205876 | A1 * | 8/2010 | Christopoulus | E04H 9/02 52/167.3 |
| 2013/0185026 | A1 * | 7/2013 | Vanker | G06F 17/5004 703/1 |

* cited by examiner

*Primary Examiner* — Joshua J Michener

(74) *Attorney, Agent, or Firm* — Pharmaceutical Patent Attorneys, LLC

(57) ABSTRACT

An improved steel stud wall panel which includes a diagonal member able to be placed under tension during installation. The diagonal tension imparts rigidity to the wall panel, preventing warp.

8 Claims, 4 Drawing Sheets

4
9
7a
7b
7c
7d
7e
A SIDE VIEW
B TOP VIEW
C SECTION
D ISOMETRIC VIEW

PREFABRICATED LIGHTWEIGHT STEEL WALL TENSIONING SYSTEM

RELATED APPLICATIONS

This application claims priority from U.S. Provisional Application Ser. No. 62/068,820, filed 27 Oct. 2014, the contents of which are here incorporated by reference.

GOVERNMENT INTEREST

None

BACKGROUND

To construct a building, it is known in the art to build a wall as a frame having a horizontal sill plate on the bottom and a horizontal top plate on the top, connected by a series of vertical studs. These components had for decades been made of wood. More recently, light weight steel has been adopted for this.

Such wall panels may be cost-effectively pre-assembled in a manufacturing facility and shipped to a building site for a comparatively rapid final assembly. Pre-fabricated wall frames, however, must be moved, and moving may torque the wall frame and distort its shape. Thus, pre-fabricated wall frames should be stabilized against torsional and other stress to maintain the wall panel shape. This is typically done by welding to the wall panel at least one tensioned steel strap running diagonally across a face of the wall frame. This is shown in FIG. 1, which shows the bottom portion of a wall panel having a base plate [2], a plurality of vertical steel studs [6] and/or shearwall posts [1] placed in a baseplate notch [3]. A diagonal strap(s) [4] is tack-welded [5] to the base of the shearwall post [1]. The diagonal strap is installed under tension using a standard steel strap tensioning tool and welded in place.

This prior art construct stabilizes the pre-fabricated wall panel during transit and installation. After installation, however, when load is placed on the wall panel, the load may be greater than the tension on the strap, causing the strap to lack tension; when this happens, the steel strap may buckle outward from the wall panel, damaging the gypsum or other wall panel covering.

To remedy such strap buckling, the skilled artisan currently cuts the welded strap from the installed wall panel, re-sets the strap and re-welds it to the wall panel in situ at the building construction site. This process, however, is time-consuming, and thus is both expensive and frustrates one of the advantages of pre-fabricated construction: the ability to construct a building quickly. There is thus a need in the art for a way to stabilize pre-fabricated wall panels for shipping, while avoiding the need to remove and re-weld stabilizing straps. We have found a way.

BRIEF DESCRIPTION

Our invention entails an improved stabilizing strap having an integral tensioning means, whereby a strap installed on a wall panel may be tensioned as needed without disconnecting the strap from the wall panel.

DETAILED DESCRIPTION

Figure 1:
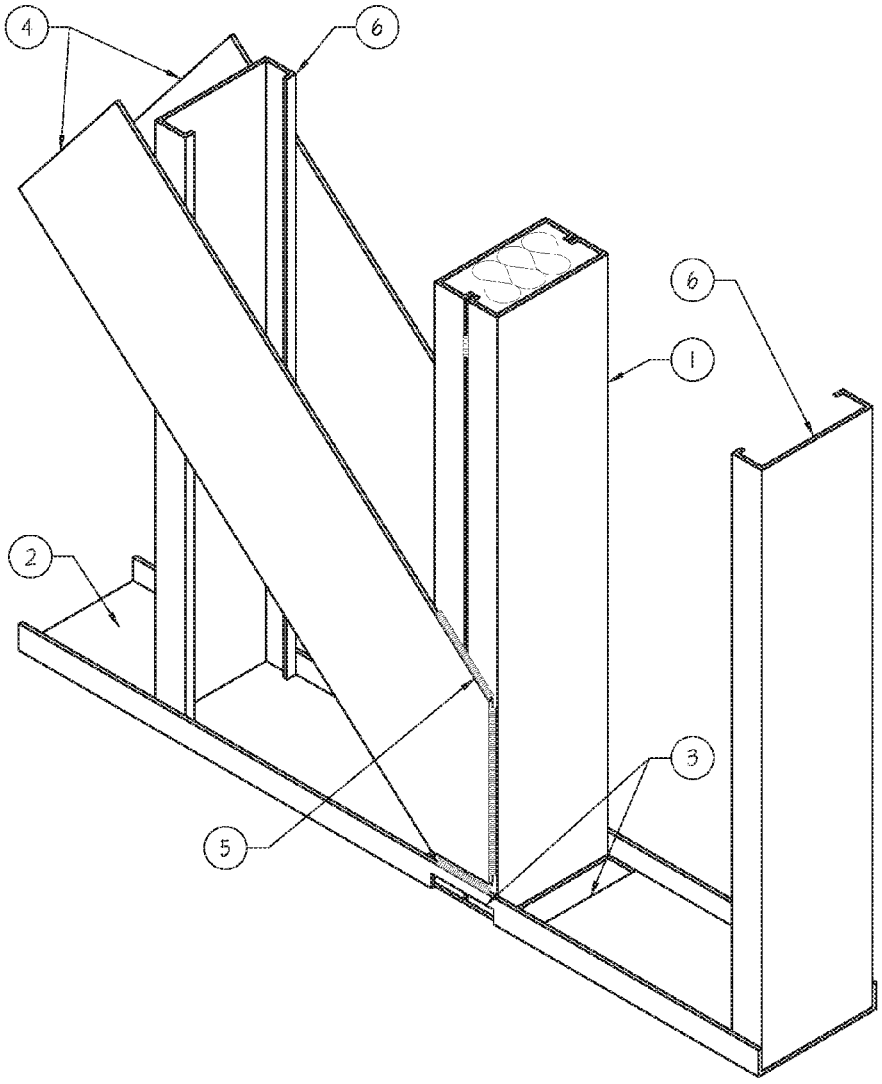
FIGURE 1 PRIOR ART
FIG. 1 shows a typical prior art configuration.
Figure 2:
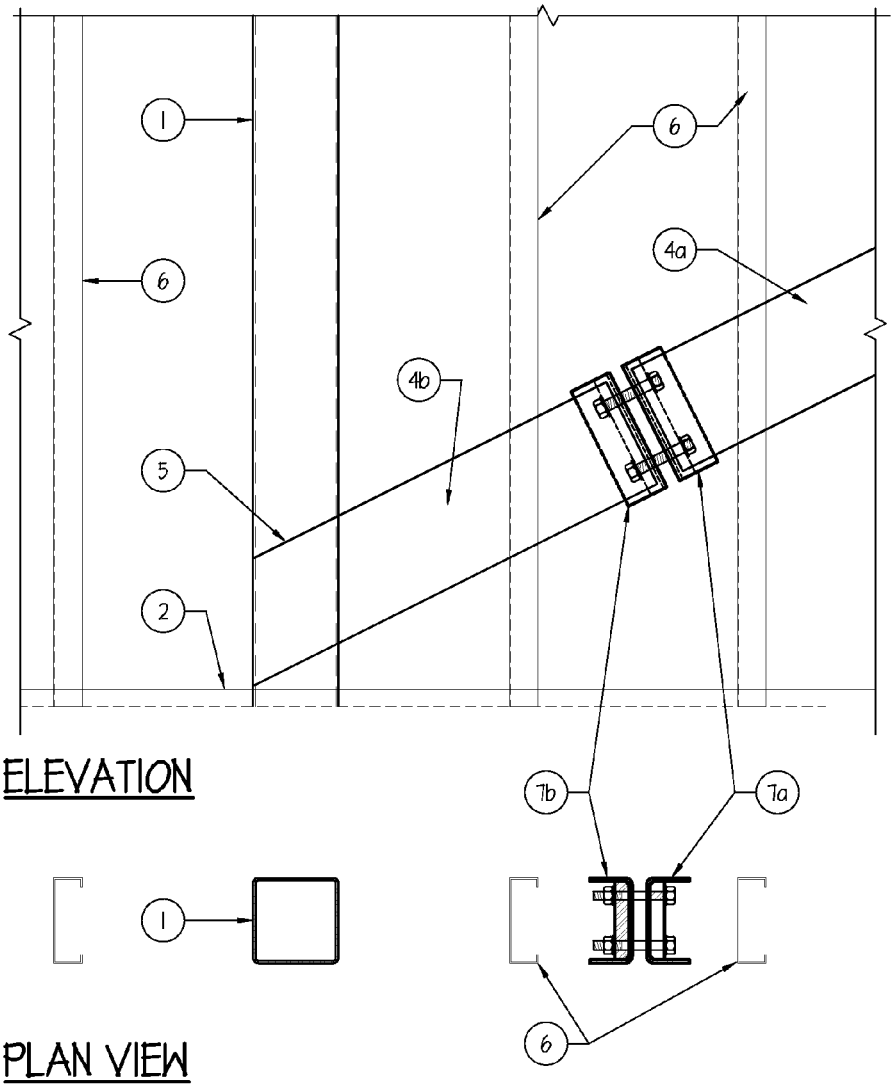
FIG. 2 shows an example of our adjustable shearwall assembly, elevation and plan views.

Our invention may be easily understood by looking at FIG. 2, which shows one example of our system.

FIG. 2 shows an elevation view of the bottom portion of a prefabricated steel stud wall panel. The panel has a base plate [2] bearing a vertical shearwall post [1] and a plurality of vertical studs [6].

Attached to one of the vertical members is a first diagonal member [4*b*]. We prefer the first diagonal member [4*b*] be a flat steel strap. One could alternatively use a strap made of other material (e.g., nylon), but this may complicate fire code compliance testing etc. One could also use a steel cable, rod or other member with a significant depth. Doing so, however, would require cutting notches or holes in each of the vertical studs [6] to accommodate the diagonal member, complicating the fabrication process and reducing the theoretical load bearing capacity of each vertical stud [6].

We prefer to attach the first diagonal member [4*b*] to a shearwall post [1] because a post [1] provides greater structural strength than does a stud [6]. We prefer to attach [5] the first diagonal member [4*b*] by a weld. One could alternatively use fasteners (e.g., sheet metal screws) or an adhesive.

Attached to the upper portion of another vertical member (not shown) is a second diagonal member [4*a]*.

The second diagonal member [4*a*] and first diagonal member [4*b*] are adjustably joined by a joint [7]. The joint [7] is adjustable and thus allows an installation mechanic to increase tension on the diagonal members [4*a*, 4*b*] after the wall panel has been installed.

Figure 3:
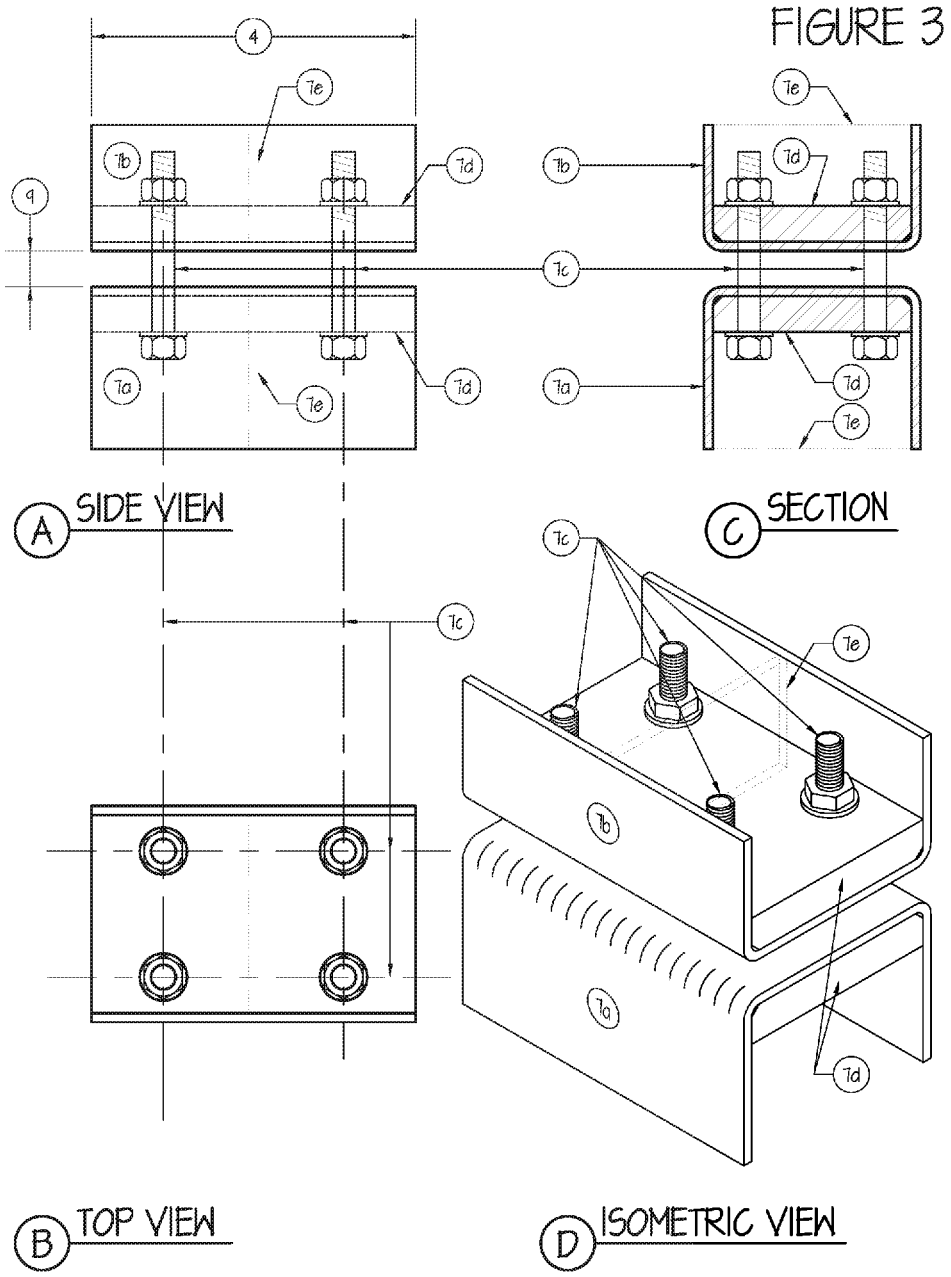
FIG. 3 shows a detailed view of an exemplary adjustment mechanism, side, top, section and isometric views.

An example of an adjustable joint is shown in FIG. 3. The joint may be readily made from two pieces of conventional C channel steel [7*a*, 7*b*] connected by at least one bolt [7*c*]. The exemplary joint illustrated in FIG. 3 uses four bolts [7*c*] (and appurtenant washers and nuts). One may use more or less bolts as appropriate; it may be least expensive to fabricate and install this kind of joint using only one bolt sited at or near the center of the face of the C channel. The steel C channel [7*a*, 7*b*] may be reinforced with a block [7*d*] to prevent the bolts from pulling through the face of the C channel. The steel C channel may, alternatively or in addition, be reinforced with a flange [7*e*] to maintain the C channel in its proper intended conformation. One may (as illustrated) use a nut to anchor the bolt [7*c*]. Alternatively, one may thread a hole(s) in the reinforcing block [7*d*] and screw the bolt directly into the block, eliminating the need for a nut. Similarly, if the C channel stock has appropriate strength, one may thread a hole in the C channel and screw the bolt directly into the C channel. The two halves of the join [7*a*, 7*b*] are separated by a gap [9] for adjustment; we have found a gap of roughly 1" works well.

One may alternatively use another type of adjustable joint. For example, if one fashions the diagonal members [4*a*, 4*b*] from cable rather than strap, then one may use a turnbuckle as the joint [7]. Similarly, if one fashions the diagonal members [4*a*, 4*b*] from nylon webbing, then one may use a conventional ratchet-type strap tightening clasp, e.g., a Kiln Case Tightener, commercially available from Paragon industries, Inc., Mesquite Tex. The critical requirement is that the joint must be sufficiently adjustable to take up any undesirable slack in the diagonal members [4*a*, 4*b*] after installation.

Figure 4:
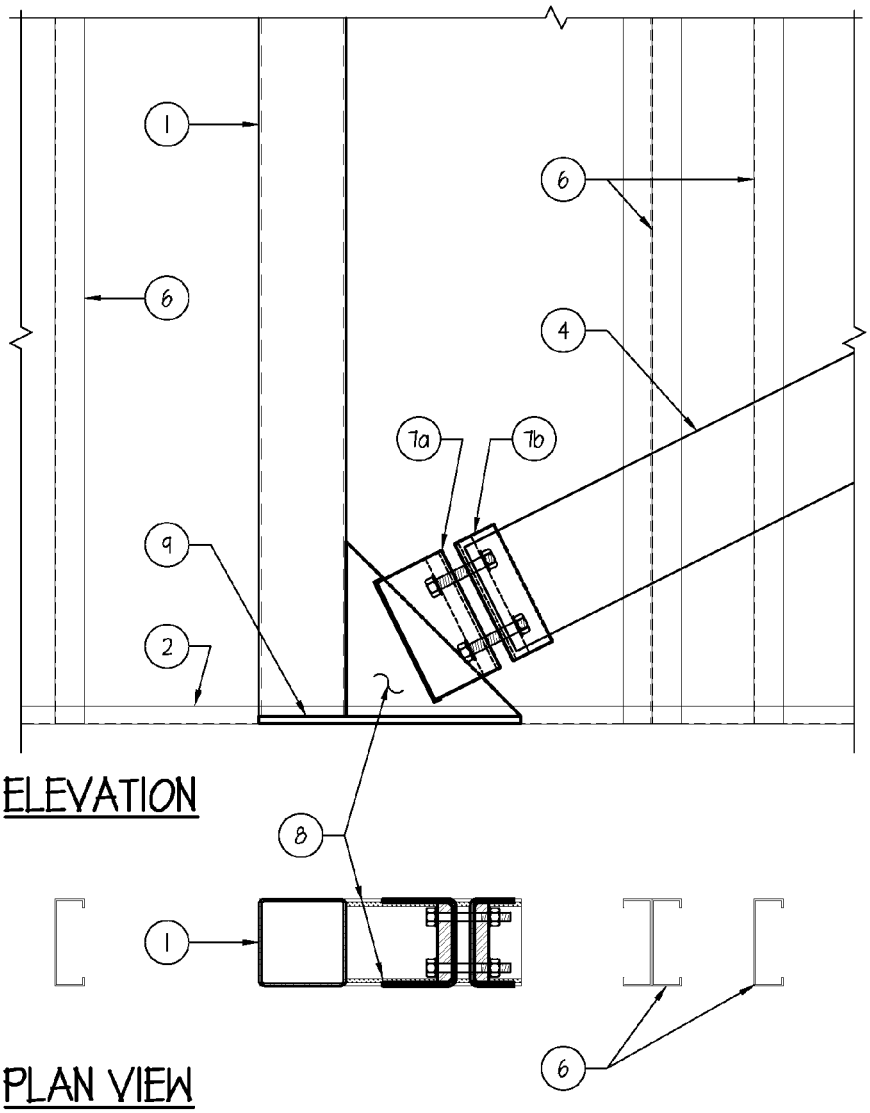
FIG. 4 shows another example of our adjustable shearwall assemply, elevation and plan views.

One may alternatively dispense with the second diagonal member [4*a*]. To do so, one can attach one end [7*a*] of the adjustable joint [7] directly to the baseplate [2], a shearwall post [1] or a stud [6]. If this approach is taken, we prefer to attach to a post [1], and further prefer the attachment incorporate a gusset plate [8] as shown in FIG. 4. We prefer the gusset plate [8] be attached to both the baseplate [2] and post [1] (as exemplified in FIG. 4).

Given our disclosure, the artisan will readily arrive at alternatives. We thus intend the legal coverage of our invention to be defined by the appended legal claims and their permissible equivalents, rather than by the specific example illustrated here.

We claim:

1. A prefabricated steel wall comprising:

a. A substantially-horizontal steel sill plate connected to a substantially-horizontal steel top plate by a plurality of substantially-vertical members selected from the group consisting of: stud, post and combinations thereof;

b. A diagonal member connected to an adjustable joint to form a jointed member having a lower end and an upper end;

c. The jointed member diagonally disposed relative to the substantially-vertical members, the jointed member lower end affixed to the sill plate, a bottom portion of a post or both, the jointed member upper end affixed to the top plate, an upper portion of a post or both;

d. Whereby the adjustable joint may be adjusted to remove undesired slack in the diagonal member after installation of the prefabricated steel wall panel, where the adjustable joint comprises two steel C channel sections connected by at least one bolt.

2. The prefabricated steel wall panel of claim 1, where the steel C channel sections further comprise a reinforcing block disposed in the interior cavity of each C channel.

3. The prefabricated steel wall panel of claim 1, where the adjustable joint comprises two steel C channel sections connected by two to four bolts.

4. A prefabricated steel wall comprising:

a. A substantially-horizontal steel sill plate connected to a substantially-horizontal steel top plate by a plurality of substantially-vertical members selected from the group consisting of: stud, post and combinations thereof;

b. A diagonal member connected to an adjustable joint to form a jointed member having a lower end and an upper end;

c. The jointed member diagonally disposed relative to the substantially-vertical members, the jointed member lower end affixed to the sill plate, a bottom portion of a post or both, the jointed member upper end affixed to the top plate, an upper portion of a post or both;

d. Whereby the adjustable joint may be adjusted to remove undesired slack in the diagonal member after installation of the prefabricated steel wall panel, where the diagonal member comprises steel strap and where at least one end of the jointed member is affixed by using a gusset, and where the adjustable joint comprises two steel C channel sections connected by a plurality of bolts.

5. A prefabricated steel wall comprising:

a. A substantially-horizontal steel sill plate connected to a substantially-horizontal steel top plate by a plurality of substantially-vertical members selected from the group consisting of: stud, post and combinations thereof;

b. A diagonal member connected to an adjustable joint to form a jointed member having a lower end and an upper end;

c. The jointed member diagonally disposed relative to the substantially-vertical members, the jointed member lower end affixed to the sill plate, a bottom portion of a post or both, the jointed member upper end affixed to the top plate, an upper portion of a post or both;

d. Whereby the adjustable joint may be adjusted to remove undesired slack in the diagonal member after installation of the prefabricated steel wall panel, wherein the joined member further comprises a second diagonal member, wherein the adjustable joint is disposed between the diagonal member and the second diagonal member, so that the diagonal member, the adjustable joint and the second member together form the joined member having a lower end and an upper end and where the adjustable joint comprises two steel C channel sections connected by at least one bolt.

6. The prefabricated steel wall panel of claim 5, where the steel C channel sections further comprise a reinforcing block disposed in the interior cavity of each C channel.

7. The prefabricated steel wall panel of claim 5, where the adjustable joint comprises two steel C channel sections connected by two to four bolts.

8. A prefabricated steel wall comprising:

a. A substantially-horizontal steel sill plate connected to a substantially-horizontal steel top plate by a plurality of substantially-vertical members selected from the group consisting of: stud, post and combinations thereof;

b. A diagonal member connected to an adjustable joint to form a jointed member having a lower end and an upper end;

c. The jointed member diagonally disposed relative to the substantially-vertical members, the jointed member lower end affixed to the sill plate, a bottom portion of a post or both, the jointed member upper end affixed to the top plate, an upper portion of a post or both;

d. Whereby the adjustable joint may be adjusted to remove undesired slack in the diagonal member after installation of the prefabricated steel wall panel, wherein the joined member further comprises a second diagonal member, wherein the adjustable joint is disposed between the diagonal member and the second diagonal member, so that the diagonal member, the adjustable joint and the second member together form the joined member having a lower end and an upper end, wherein the joined member further comprises a second diagonal member, wherein the adjustable joint is disposed between the diagonal member and the second diagonal member, so that the diagonal member, the adjustable joint and the second diagonal member together form the joined member having a lower end and an upper end, where the diagonal member comprises steel strap and where at least one end of the jointed member is affixed by using a gusset, and where the adjustable joint comprises two steel C channel sections connected by a plurality of bolts.

* * * * *